United States Patent [19]

Clark

[11] 4,393,612

[45] Jul. 19, 1983

[54] PADDED FRAME

[76] Inventor: Susan Clark, 7270 Prow Way, Dublin, Calif. 94566

[21] Appl. No.: 389,854

[22] Filed: Jun. 18, 1982

[51] Int. Cl.[3] ..... A47G 1/06; G09F 1/12

[52] U.S. Cl. ..... 40/152; 40/154; 40/158 R

[58] Field of Search ..... 40/158 B, 158 R, 159, 40/152, 152.1, 156, 157, 124.1, 154, 155, 615, 616

[56] References Cited

U.S. PATENT DOCUMENTS

| | | | |
|---|---|---|---|
| 2,256,399 | 9/1941 | MacHarg | 40/152 |
| 2,428,242 | 9/1947 | Prost | 40/154 |
| 3,611,604 | 10/1971 | Saltzman | 40/156 |
| 3,994,087 | 11/1976 | Koeppen | 40/152 |
| 4,158,266 | 6/1979 | Gilmour | 40/152 |
| 4,164,085 | 8/1979 | Steeb et al. | 40/152 |

FOREIGN PATENT DOCUMENTS

| | | | |
|---|---|---|---|
| 7507113 | 12/1976 | Netherlands | 40/152 |

*Primary Examiner*—Gene Mancene
*Assistant Examiner*—Michael J. Foycik, Jr.
*Attorney, Agent, or Firm*—Bruce & McCoy

[57] ABSTRACT

A padded frame and method for making the same from decorative covering material and mounting board having an adhesive surface on one side thereof and a foam sponge material secured to the other.

7 Claims, 5 Drawing Figures

PADDED FRAME

BACKGROUND OF THE INVENTION

1. Field of the Invention

The present invention relates to padded frames. More particularly it relates to a padded picture frame made from a mounting board having a layer of foam sponge material secured thereto on one side thereof and an adhesive surface on the opposite side thereof. It also relates to the method for making the same.

2. Description of the Prior Art

Padded picture frames have been made by traditional or obvious processes which has been modified somewhat by modern materials. In times past in homes where materials were scarce, such as on a farm or in the country, picture frames were made from cardboard and cloth rather than from glass with a surrounding wooden frame. This was done by utilizing a mounting board of a suitable size to cover the picture to be framed and then cutting a hole in the center of the mounting board to surround the actual portion of the picture to be exposed for viewing. In many instances this center opening was an oval simply because in most cases the picture was a photograph of a person and the picture was in effect cropped by the opening used to frame it. The padded picture frame permitted this type of a mounting exposure unlike picture frames made with glass and a surrounding frame which usually show the whole picture.

The padded frame was made by gluing batting to the front or exposed surface of the mounting frame to provide the padded underlayment for the decorative fabric cover. The decorative fabric material was then stretched over the batting material and wrapped around the edges of the frame and secured to it with glue. While the glue dried, straight pins held the material along the edge of the mounting frame and clothes pins on the corners held the material where it was folded over and glued double layered to the back of the mounting frame. The same technique of securing the fabric to the frame was also used for the center of the mounting frame. By cutting a hole in the center of the fabric and then folding the edges back through the opening in the frame to the back side of the mounting board, the fabric could also be secured to the mounting board around the edges of the center opening on the back side thereof with glue and pins. The decorative covering material in combination with the batting effected a contoured external surface for the padded frame.

A modern improvement in this technique occurred when double faced tape such as carpet tape became available. It could be secured along the edges of the mounting board and around the center opening, and the fabric was then simply wrapped around and stuck to the double faced tape. This greatly simplified the making of these picture frames, and such frames have been described in crafts magazines and possibly sold by the hobby industry in kit form.

There still are several disadvantages to making even these simplified padded frames. The main one is that the batting is very difficult to arrange to provide a smooth molded contour without lumps and which will maintain its shape and provide a uniform bulging appearance.

A further problem in making a padded frame is providing it with a back cover. The external rear surface of the cover is provided with a matching decorative fabric the same as that of the frame, but for some reason it is usual to provide a contrasting fabric on the inside surface for backing the picture to be placed in the frame and this contrasting fabric also needs to be secured to the back cover.

The present invention makes it simplier to construct a padded frame than by using the known prior art means. This is done by supplying materials having adhesive surfaces already disposed thereon and covered with a protective mask which can be selectively removed to expose only that portion of the adhesive necessary for constructing the padded frame.

SUMMARY OF THE INVENTION

The padded frame of the present invention includes a mounting board having a uniform layer of foam sponge material secured to one side of it. The mounting board has an opening in the center for framing a picture or other object. Bands of adhesive surfaces are exposed on the opposite side of the mounting board from the sponge layer and surround the periphery of the mounting board and the opening in the center. The adhesive is a contact glue which secures almost anything to it that is applied thereto with pressure. A decorative covering material is stretched over the foam sponge material layer squeezing it to the mounting board around the border of the mounting board and around the opening of the center thereof. The covering material is wrapped around the edges of the mounting board, and around the edge of the center opening, and stuck to the adhesive surfaces on the reverse side of the mounting board from the foam material.

The present invention also includes a rear cover which is formed by a mounting board of the same size as the mounting board of the padded frame. The rear cover mounting board has an adhesive surface around its periphery. A decorative covering material is wrapped around the reverse surface of said rear cover mounting board from the adhesive surface and around the edges of the board and thereby secured to the adhesive surface. The rear cover is secured to the padded frame by double sided adhesive tape disposed around the periphery of a portion of the rear surface of the frame. The portion of the periphery of the frame where there is no double sided adhesive tape allows a picture to be inserted into the frame between the rear cover and the frame.

The present invention further includes an easel which is covered with a decorative covering material and secured to the rear cover.

The present invention also includes the method of making a padded frame. The steps comprise providing a mounting board of the desired size and configuration having a uniform layer of foam sponge material secured to one side of it and an adhesive surface disposed on the opposite side covered by a removable protective mask. An opening is formed in the center of the mounting board to frame a picture or other object. A portion of the protective mask is selectively removed in a band from around the periphery of the mounting board and around the opening in the center of the board. A piece of decorative covering material is stretched over the sponge material to compress the edges of the sponge material to the mounting board. The decorative material is wrapped around the edges of the mounting board and secured to the adhesive bands disposed around the periphery of the frame on the reverse side thereof. A portion of the decorative material disposed in the middle of the opening is removed and slits are cut in the material around the internal periphery of the opening in the material. The slit portions of the decorative material are wrapped through the opening and secured to the adhesive band surrounding the opening on the reverse side of the mounting board. Finally, a means is provided for securing a picture or other object in appropriate position to the covered adhesive side of the frame.

OBJECTS OF THE INVENTION

It is therefore an important object of the present invention to provide a simplified means of making a padded frame.

It is another objection of the present invention to provide a padded frame which can be assembled from a kit without the need for glue, sewing pins, batting, or clothes pins.

It is a further object of the present invention to provide a means for making a padded frame in which very smooth and uniform contours can be formed on the projecting padded portion of the frame surrounding the framed picture or other object.

It is yet another object of the present invention to provide a padded frame kit in which the adhesive for securing the decorative covering material to the mounting frame and rear cover is provided integrally to the mounting boards and can be activated by selectively removing a portion of a protective mask only where an adhesive surface is required.

It is yet a further object of the present invention to provide a padded frame which can be covered with any type or design of decorative covering material by simply pressing the selected material to the adhesive surfaces on the mounting board.

It is still another object of the present invention to provide a padded frame which has a matching rear cover and easel which are likewise made from mounting boards having adhesive surfaces integral thereto which are actuated by selectively removing a protective mask only where an adhesive surface is required.

And it is still a further object of the present invention to provide a new and useful method for making a padded frame.

Other objects and advantages of the invention will become apparent when the description of the preferred embodiment is considered in conjunction with the accompanying drawings.

DESCRIPTION OF THE PREFERRED EMBODIMENT

Figure 1:
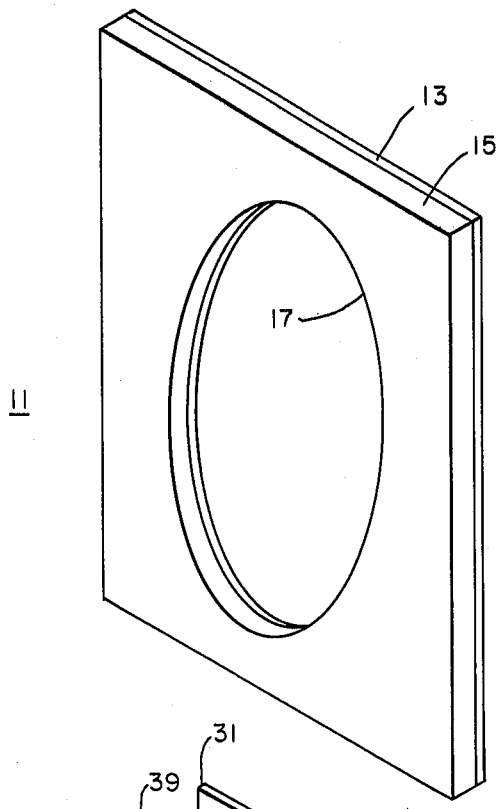
FIG. 1 is a perspective view of a preferred embodiment of the invention without a decorative fabric secured thereto.

The padded frame 11 of the present invention and illustrated by FIG. 1 includes a mounting board 13 having a uniform layer of soft foam sponge material 15 secured thereto on the exposed side thereof. The mounting board has at least one opening 17 for framing a picture or other object. The opening can be of any configuration but padded picture frames most often utilize an oval opening in the frame. The frame can also include multiple openings, and it can be used to frame flower arrangements, minatures, montages, needle point, and keepsake items to name a few.

Bands of adhesive surfaces 19, 21 are disposed on the back side of the mounting board opposite from the sponge layer. These bands are generally approximately ½ inch wide and one band 19 surrounds the periphery of back side of the mounting board 19 and another band 21 surrounds the back side of the opening in the center thereof. In the preferred embodiment, the whole back side of the mounting board is an adhesive surface which is covered by a protective layer 23 such as a waxed, plastic coated, or chemically treated release paper. This protective layer is called the adhesive mask. The adhesive bands are formed by simply cutting with a knife through the protective mask around the border of the board and around the opening and then peeling off the mask to expose narrow bands of the adhesive surface underneath surrounding the edge of the board and the center opening.

It has been found that by also providing an adhesive surface on the foam sponge layer 15 on the front of the board makes the assembly of the padded picture frame easier although this additional adhesive surface is not necessary to the invention. The adhesive surface on sponge layer is also covered with a mask 25 until the adhesive is activated by removing it.

A decorative covering material (usually a printed fabric) 27 is stretched over the foam sponge material layer 15 on the front of the mounting board (and stuck to it if it is provided with adhesive) and squeezes the sponge to the mounting board 13 around the periphery of the board and around the opening in the center thereof when the fabric 27 is wrapped around the edges of the mounting board. The foam sponge material forms a smoothly projecting or bulging surface under the fabric. The fabric which is wrapped around the edges of the mounting board is stuck to the exposed bands of adhesive surface 19 on the back side of the board. A portion of the fabric in the center of the opening of the mounting board is removed and slits or notches are cut into the fabric generally perpendicularly to the edge of the opening at spaced locations therearound. The slit fabric tabs 29 are also wrapped around the edge of the opening 17 onto the back side of the mounting board and stuck to the exposed band of adhesive 21 surrounding the edge of the opening.

Figure 3:
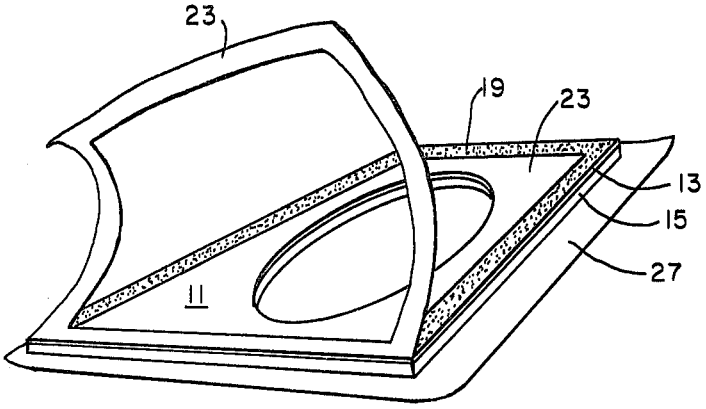
FIG. 3 is a perspective view of the padded picture frame of the present invention showing the adhesive mask partly removed.

FIG. 3 of the drawings shows the decorative fabric 27 stuck to the sponge layer 15 on the front of the mounting board and a portion of the mask 23 being removed from the back side to expose the band of adhesive 19 around the periphery of the mounting board.

Figure 4:
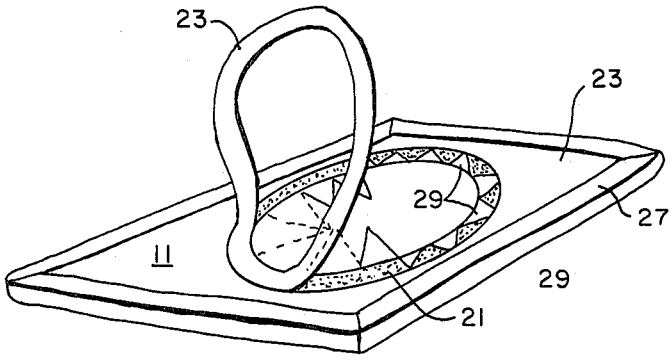
FIG. 4 is the perspective view of FIG. 3 showing the fabric cover partially secured to the exposed adhesive surface and a further portion of mask partly removed.

FIG. 4 shows the decorative fabric 27 stretched around the edges of the mounting board and secured to the peripheral band of adhesive 19. In the center of the mounting board, a portion of the mask 23 is being removed to expose the band of adhesive 21 around the opening 17. The tabs 31 of the decorative fabric have been stretched up through the opening and secured to that portion of the adhesive band 21 surrounding the opening which has been exposed by the removal of the mask.

By simply placing a picture hook on the rear of the padded frame heretofore described constitutes a completed frame for hanging on the wall if provision is made for holding a picture or other object to the frame in the appropriate position (such as by adhesive tape). However, the padded frame of the present invention can also include a rear cover 31 formed by a mounting board 33 which is the same size as the mounting board for the padded frame 11.

The rear cover mounting board 33 also has an adhesive surface disposed around the periphery of the inside surface thereof, and a decorative fabric can be wrapped around the outer reverse side of the rear cover mounting board, around the edges thereof, and secured to the peripheral band of adhesive on the inside surface. In practice, for ease of assembly, the rear mounting board can also be provided with an adhesive surface completely covering one or both sides thereof the same as with the padded picture frame mounting board. A protective mask covers the whole or both adhesive surfaces and only the edge portion or approximately a ½ inch band of the mask need be removed around the edge of the rear cover mounting board to secure the fabric thereto 35. The fabric can also be stuck to the outer side of the rear cover mounting board if it is also provided with adhesive.

It is also sometimes desirable to provide a contrasting or different decorative fabric 37 to cover the center portion of the inside surface of the rear cover which is not covered by the decorative fabric wrapped around the edge of the board from the outer side. This is done simply by removing the remaining portion of the mask 39 from the inside adhesive surface and cutting a piece of decorative fabric the size of the exposed adhesive surface and sticking it thereto. A contrasting design shows through the opening if there is no picture in the frame.

Figure 2:
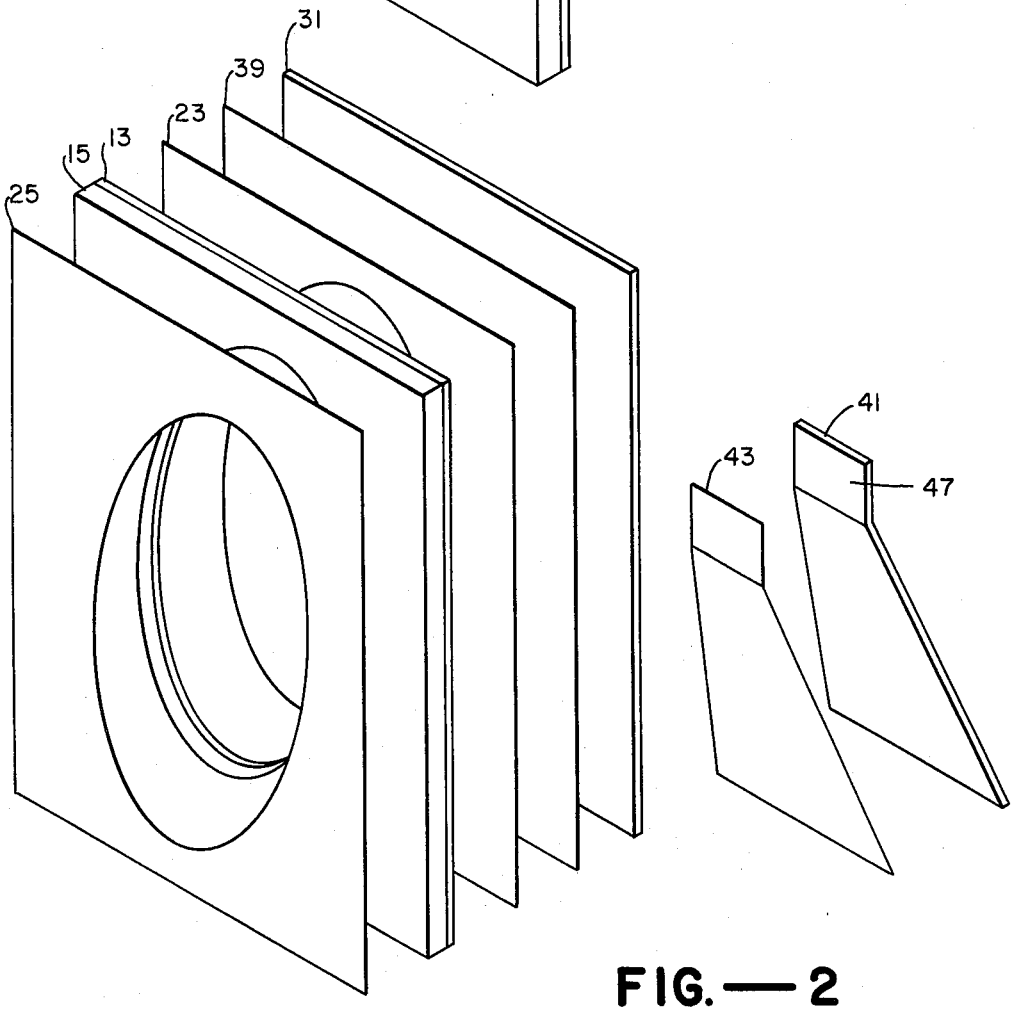
FIG. 2 is an exploded view of the assembly of the present invention without the decorative fabric secured thereto.

FIG. 2 of the drawings shows the layers of materials and the masks which comprise the mounting boards of the present invention. The first mask 25 covers the adhesive surface on the foam material. The foam layer 15 is glued to the picture frame mounting board, and the second mask 23 covers the adhesive surface on the rear of the mounting board 13. The third mask 39 covers the adhesive surface on the inside of the rear cover, and a further mask (not shown) would cover the outer side of the rear cover if both sides of the rear cover had adhesive surfaces. The easel 41 is made out of the same material as the rear cover mounting board and likewise has an adhesive mask 43.

The rear cover 31 is secured to the padded frame 11 by utilizing double sided adhesive tape 45 disposed around the periphery of a portion of the rear side of the padded frame. If the frame is rectangular, then three sides would be provided with the double edged tape to stick the rear cover to the frame leaving the fourth side unobstructed to permit a picture to be inserted between the cover and the frame at that fourth side. If the frame is not rectangular, then a portion of the periphery of the frame is left without the double sided adhesive tape whereby a picture can be inserted into the frame at the edge portion thereof where the rear cover is not secured to the frame.

Figure 5:
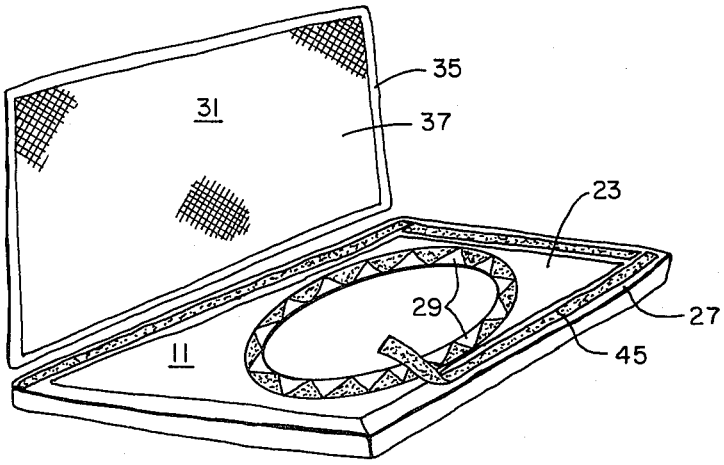
FIG. 5 is the perspective view of FIG. 4 showing the fabric cover secured to the frame, a rear cover, and the double sided adhesive strip for securing the rear cover to the frame.

FIG. 5 shows a completed padded picture frame 11 with a double faced adhesive tape 45 disposed around three of the peripheral edges thereof for securing the rear cover 31 to the frame. The rear cover has an outer decorative fabric 35 which covers the outer surface of the cover and around the inside surface edges. Also shown is the contrasting fabric piece 37 which covers the center section of the inside surface of the rear cover.

The present invention can also include an easel 41 which is also covered with a decorative fabric. The easel is secured to the rear cover to support the padded frame when it is set up on a table or other flat surface rather than being hung on the wall. The easel can be made of mounting board material likewise having an adhesive surface on one side thereof covered with a protective mask 43. When the mask is removed, the decorative fabric can be wrapped around the easel and secured thereto. The easel then can be secured by the top end tab portion 47 thereof to the rear surface of the rear cover by means of double sided adhesive tape or the tab portion 47 of the easel can be left uncovered with the mask removed and stuck to the rear cover by the adhesive surface.

The advantage of the present invention is that the use of foam sponge as the padded material on the front side of the frame permits a very smooth rounded configuration to be formed with much greater uniformity than can be achieved with batting. By utilizing the adhesive surfaces covered with a protective mask that can be selectively removed to expose the adhesive, a kit for making padded frames can be provided in which no adhesive needs to be supplied separately. The adhesive can be easily activated by simply selectively removing a portion of the mask. The decorative material can be secured to the adhesive surface by simply pressure contact without the need of holding it there until glue dries. This greatly simplifies the ability to provide a kit for making a padded frame and for the assembly of the kit by an inexperienced padded frame maker.

It will be seen from the foregoing description of the preferred embodiment of the present invention that all the objects attributable thereto can be achieved, and while the invention has been described in considerable detail, it is not to be limited to the specific details set forth except as may be necessitated by the appended claims.

I claim:

1. A padded frame comprising a mounting board having a uniform layer of foam sponge material secured thereto on one side thereof and having at least one opening for framing a picture or other object.

bands of adhesive surfaces disposed on the opposite side of said mounting board from said sponge layer and surrounding the periphery of said mounting board and the opening therein and a decorative covering material stretched over said sponge material layer and squeezing it to the mounting board around the border of said mounting board and around the opening in the center thereof, said covering material being wrapped around the edges of said mounting board and the edge of said opening and stuck to said adhesive surfaces on the reverse side thereof.

2. A padded frame comprising a mounting board having a uniform layer of foam sponge material secured thereto on one side thereof and an adhesive surface disposed on the opposite side of said mounting board from said sponge layer, said adhesive surface being partially covered by a protective mask, at least one opening disposed in said mounting board formed to frame a picture or other object, a border portion of said adhesive surface being exposed both around the periphery of said mounting board and around said center opening, a decorative covering material stretched over said sponge material layer and squeezing it to the mounting board around the border of said mounting board and around the opening in the center thereof, said covering material being wrapped around the edges of said mounting board and the edge of said center opening and stuck to said adhesive surface on the reverse side thereof.

3. The padded frame of claim 1 including a rear cover formed by a mounting board having an adhesive surface disposed around the periphery thereof and a decorative covering material wrapped around the reverse surface of said rear cover mounting board and around the edges thereof and being secured to said adhesive surface, said rear cover being secured to said padded frame by double sided adhesive tape disposed around a portion of the periphery of said padded frame whereby a picture can be inserted into said frame at the edge portion thereof where the periphery of the rear cover is not secured to said padded picture frame.

4. The rear cover of claim 3 wherein the side of the mounting board having the adhesive surface is completely covered by adhesive and that portion not exposed for securing the decorative covering material thereto is covered by a removable protective mask.

5. The padded frame of claim 3 including an easel having adhesive surfaces covered with decorative covering material stuck thereto, said easel being secured to said rear cover.

6. A padded picture frame comprising a mounting board having a uniform layer of foam sponge material secured thereto on one side thereof, an adhesive surface disposed on the opposite side of said mounting board, said adhesive surface being partially covered by a removeable protective mask, at least one opening disposed in said mounting board formed to frame a picture or other object, a border portion of said adhesive surface being exposed both around the periphery of said mounting board and around said center opening, a decorative covering material stretched over said sponge material layer and squeezing it to the mounting board around the border of said mounting board and around the opening in the center thereof, said covering material being wrapped around the edges of said mounting board and the edge of said opening and stuck to said adhesive surface on the reverse side thereof, a rear cover formed by a mounting board of the same size as the mounting board of said padded picture frame, said rear cover mounting board having an adhesive surface on the internal side thereof, a decorative covering material wrapped around the outside surface of said rear cover mounting board and around the edges thereof and being secured to said adhesive surface, a decorative covering material secured to the remainder of said adhesive surface, said rear cover being secured to said padded picture frame by double sided adhesive tape disposed around a portion of the periphery of said frame whereby a picture can be inserted into the frame at the edge portion thereof where the cover is not secured to said frame, and an easel having adhesive surfaces covered with decorative covering material stuck thereto, said easel being secured to said rear cover.

7. The method of making a padded frame comprising providing a mounting board of the desired size and configuration having a uniform layer of foam sponge material secured thereto on one side thereof and an adhesive surface disposed on the opposite side thereof covered by a removeable protective mask, forming at least one opening in the center of said mounting board to frame a picture or other object, selectively removing a portion of the protective mask in a band from around the periphery of the mounting board and from around the opening formed therein, stretching a piece of decorative covering material over the sponge material and compressing the edges of the sponge material to the mounting board, wrapping the covering material around the edges of the mounting board and securing it to the adhesive bands on the reverse side thereof, removing a portion of the decorative covering material disposed in the middle of the opening and cutting slits in the material around the internal periphery of the opening in said material, wrapping the slit portions of the covering material through the opening in the mounting board and securing them to the adhesive band surrounding the opening, and providing a means for securing a picture or other object in appropriate position on or to the frame.

* * * * *